United States Patent [19]

Straszewski et al.

[11] Patent Number: 4,527,317

[45] Date of Patent: Jul. 9, 1985

[54] BUCKLE FOR A SAFETY BELT

[75] Inventors: Klaus Straszewski, Quickborn; Erhard Ender; Herbert Krützfeldt, both of Hamburg, all of Fed. Rep. of Germany

[73] Assignee: Autoflug-Stakupress GmbH & Co., Norderstedt, Fed. Rep. of Germany

[21] Appl. No.: 456,587

[22] Filed: Jan. 7, 1983

[30] Foreign Application Priority Data

Jan. 13, 1982 [DE] Fed. Rep. of Germany ..... 3200770

[51] Int. Cl.[3] ..... A44B 19/00

[52] U.S. Cl. ..... 24/641; 24/637

[58] Field of Search ..... 24/633, 636, 637, 638, 24/639, 640, 641, 642

[56] References Cited

U.S. PATENT DOCUMENTS

| | | | |
|---|---|---|---|
| 3,562,877 | 2/1971 | Pringle et al. | 24/637 |
| 4,096,606 | 1/1978 | Stephenson | 24/641 |
| 4,136,425 | 1/1979 | Esner | 24/641 |
| 4,310,952 | 1/1982 | Robben et al. | 24/641 |
| 4,353,151 | 10/1982 | Ennerdal | 24/641 |
| 4,358,879 | 11/1982 | Magyar | 24/641 |
| 4,388,746 | 6/1983 | Krautz et al. | 24/461 |
| 4,394,792 | 7/1983 | Schmidt | 24/637 |

FOREIGN PATENT DOCUMENTS

| | | | |
|---|---|---|---|
| EP52160 | 11/1980 | Fed. Rep. of Germany | 24/641 |
| 3021796 | 12/1981 | Fed. Rep. of Germany | 24/641 |

*Primary Examiner*—William E. Lyddane
*Assistant Examiner*—Peter A. Aschenbrenner
*Attorney, Agent, or Firm*—Prutzman, Kalb, Chilton & Alix

[57] ABSTRACT

In a buckle for a safety belt a pivotable locking bar (13–17) is arranged in relation to the push-in tongue (4) in such a way that the ejector force (11) or the belt force exerting a load on the tongue urges the locking bar out of engagement. To prevent this in the closing position, there is a pivoting lever (21) which can be pivoted as a result of actuation of a slide (27) so that the locking bar (13–17) and consequently the push-in tongue (4) are released. According to the invention, this releasing pivoting movement of the locking bar is assisted because an extension piece (30) is provided on the slide (27) and a projection (32) interacting therewith is provided on the locking bar (13–17), and by means of these, when the slide (27) is pressed in, an additional torque for pivoting the locking bar into the opened position is transmitted.

7 Claims, 6 Drawing Figures

BUCKLE FOR A SAFETY BELT

DESCRIPTION

Figure 1:
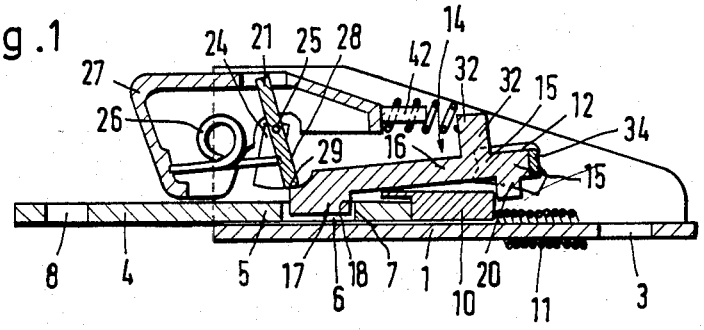

The invention relates to a buckle for a safety belt, consisting of a push-in tongue with a locking recess and of a lock with a push-in path for the push-in tongue, the said path being limited at least on one side by guide devices, being open at its front end and containing an ejector spring, with a locking bar which is mounted pivotably in the lock and the pivot axis of which extends transversely to the direction of the push-in path and which forms a locking-bar nose which interacts with the locking recess in the push-in tongue and which is movable into the push-in path from the side remote from the guide devices and is arranged so that, in the locking position, the ejector spring urges the locking bar out of engagement, and with a pivoting lever for securing the locking bar in the locking position, this pivoting lever being urged into the retaining position as a result of spring force and being removable from this, for the purpose of opening the lock, as a result of actuation of a slide guided approximately parallel to the push-in path and located on the side of the latter remote from the guide devices.

In a buckle of this type (earlier European Patent Application No. 80 10 107 136.6 of the applicant), the lock is retained in the locked position by means of the pivoting lever. Although the ejector spring and also a tensile force acting, if appropriate, on the safety belt seek to urge the locking bar out of engagement, the lock cannot open because the pivoting lever retains the locking bar firmly in the locking position. However, when the slide is pressed, the pivoting lever is removed from its locking position, so that as a result of the force of the ejector spring the locking bar is pivoted and the push-in tongue is released. It can arise, under unfavourable conditions, that the force of the ejector spring is not sufficient to pivot the locking bar, for example when the lock is soiled or after deformation in the event of an accident.

The object of the invention is, therefore, to provide a buckle of the type mentioned in the introduction, which can be opened more reliably, particularly as a result of forces to be exerted from outside by means of the slide.

The solution according to the invention involves providing the locking bar on the side remote from the guide devices with a projection which, when the slide is actuated, interacts with the latter to pivot the locking bar out of the locking position.

It is appropriate if the projection of the locking bar and the slide, which can be provided for this purpose with a projection, interact rigidly and inflexibly at least in the last phase of movement of the slide, so that the opening force exerted on the slide is transmitted fully to the projection of the locking bar. However, in addition to this or, if appropriate, even instead of this, an elastic member can be provided on the projection of the locking bar or on the slide, and this ensures that with a progressive displacement of the slide during the opening of the lock an increasing opening force is exerted on the locking bar. This produces a smooth opening force on the locking bar which makes operation of the lock convenient.

When the slide starts to be pushed in, the locking bar is first blocked by the pivoting lever. The further the slide is pressed in, the greater the force exerted thereby on the locking bar as a result of elastic coupling between the slide and the locking bar. When the slide is pressed in so far that locking is cancelled by the pivoting lever, this force of the slide acting on the locking bar has meanwhile increased to such an extent that the opening movement of the locking bar is effectively assisted. In this way, the locking bar is moved out of its locking position even if, for any reason, automatic unlocking fails because of the internal forces or the tensile force of the belt.

Elastic interaction can be achieved especially simply if the slide is provided with an extension piece which interacts with the projection of the locking bar first via an elastic part and finally, in the event of maximum compression of the elastic part, directly and inflexibly. The extension piece of the slide can consist, for example, of plastic and can have one or more arms as elastic members which engage transversely to their longitudinal direction with the projection of the locking bar and in so doing bend elastically.

The projection of the locking bar can consist of plastic. In addition to elasticity, this material also has the advantage that it can be applied to the locking bar easily and economically, for example by injectionmoulding round the latter.

The projection can be provided near the pivot axis of the locking bar. The advantage of this is that the projection executes only very slight movements perpendicularly to the push-in direction, and to that extent no substantial friction occurs between the slide or the extension piece of the slide, on the one hand, and the projection, on the other hand. The projection can be made, for example, in one piece with a plastic coating of the locking bar in the region of the pivot axis, this permitting simple production. This plastic coating can extend into the mounting of the pivot axis, so that there the bearing projections of the locking bar and the cutouts in the bearing housing, which serve for mounting the bearing projections, are separated from one another at least partially, so that rattling noises are prevented or reduced and the life of the lock is prolonged.

Figure 2:
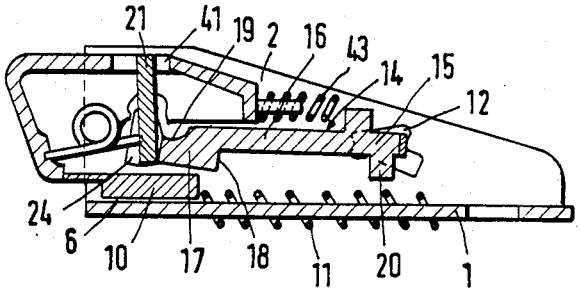
Figure 3:
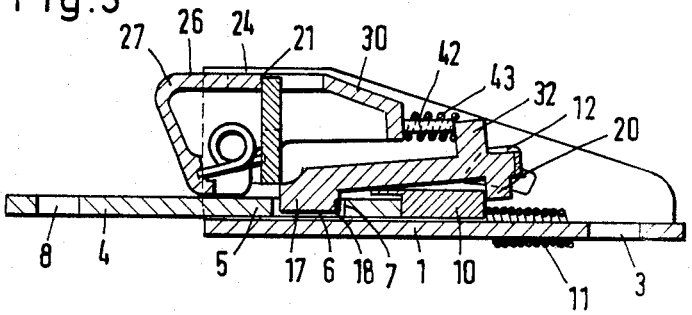
Figure 4:
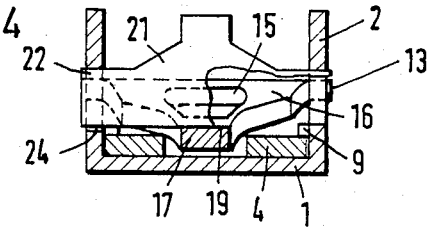
Figure 5:
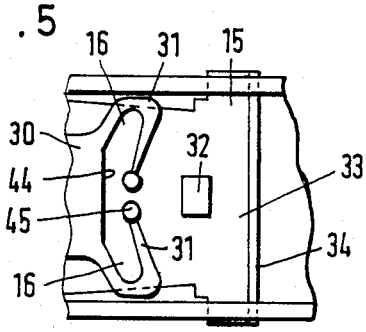
Figure 6:
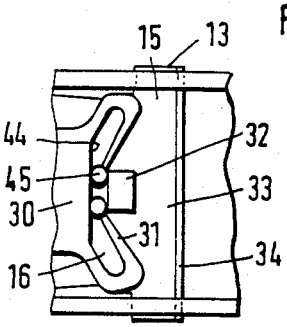

The invention is described below by way of example with reference to the attached drawing in which:

FIGS. 1, 2 and 3 show longitudinal sections through the lock in different stages of operation, FIG. 4 shows a cross-section in the region of the pivoting lever, and FIGS. 5 and 6 show a plan view of part of the buckle in a somewhat different embodiment.

The lock body consists of a plane bottom 1 and two side walls 2 projecting vertically from its parallel edges and connected rigidly to the bottom. It has a cross-section of U-shaped form. Its bottom 1 contains a bore 3 for fastening an anchoring part.

The bottom 1 and the parts of the side walls 2 adjoining it form guide devices for the push-in tongue because they constitute the lower and lateral limitation of the push-in path of the push-in tongue 4, the front part 5 of which has approximately the width of the push-in path between the side walls 2. It has a locking recess 6 which forms a locking face at 7. At its rear end, it is provided, in a known way, with a recess 8 for receiving a belt loop. Towards the top, the push-in path is limited by projections 9 connected rigidly to the lock body. The known casing of the lock body in a plastic housing is not shown for the sake of simplicity. All directional indications, such as "top", "right", "clockwise direction", etc. refer to the illustration in FIGS. 1 and 2, and "front"

and "rear" refer to the direction of the push-in movement.

The lock contains, in the push-in path, an ejector plate 10 which is guided movably therein, in a way not shown, in the direction of the push-in path and which is stressed counter to the push-in direction by a spring 11 guided in bottom slits. In FIGS. 1 to 3, therefore, the push-in path can be recognised by means of the top side of the bottom 1, by means of the position of the push-in tongue 4 and the ejector plate 10 and by means of the projections 9.

In the rear half (that is to say, on the right in the drawing) of the lock body is located, in each of the two side walls 2 at corresponding points a cut-out 12 for receiving lateral projections 13 of a locking-bar plate 14. Between the cut-outs 12 and the associated projections 13 there is so much play that the locking-bar plate 14 is pivotable through a small angle about an axis lying transversely to the push-in direction and parallel to the bottom 1. The two end positions occurring in practice during the operation of the device are shown in FIGS. 1 and 2. The locking-bar plate consists of a rear transverse part 15 connecting the projections 13 and of a plate part 16 which leads forwards in front of it and which carries at the front a downwardly projecting locking-bar part 17 forming a locking-bar nose 18 pointing to the rear. The locking-bar part 17 projects a little forwards in relation to the plate part 16, so that there forms on its top side a free face 19 limited towards the front by its front edge. In the locking state (FIG. 1), this face lies in the upper limiting plane of the push-in path or a little above it.

The locking-bar plate 14 has at its rear end at least one projection 20 which projects downwards near the axis of rotation of the locking-bar plate, determined by the front end of the cut-outs 12, and which limits the push-in path towards the rear. It serves, together with the ejector plate 10, for the positive locking of the push-in tongue. In particular, when pushed in, the latter moves the ejector plate 10 to the rear counter to the pressure of the ejector spring 11, the ejector plate 10 being made so long that it just butts against the projection 20, thereby causing rotation of the locking bar to the left in an anti-clockwise direction, when the locking face 7 of the push-in tongue 4 has just passed through under the locking-bar nose 18 of the locking-bar part 17.

The locking-bar nose 18 of the locking-bar part 17 is, in the locking state, approximately perpendicular to the direction of the push-in path and at an obtuse angle to the connecting line with the locking-bar axis. When a force is exerted on the locking-bar nose 18 to the left in the direction of the push-in path, for example by means of a belt force acting on the push-in tongue or by means of the ejector spring 11, there is consequently exerted on the locking bar a torque which is formed by the force acting in the push-in path and the distance between the push-in path and the axis of rotation of the locking bar, as a lever arm. This torque seeks to rotate the locking bar in a clockwise direction, to lift the locking-bar part 17 out of the locking-bar recess in the push-in tongue and thus to release the lock. This is prevented, in the locking state, by the pivoting lever 21. This pivoting lever 21 is located above the upward-pointing face 19 of the locking part 17. It is designed as a plate which extends transversely in the lock body and the outline of which may be seen on the left in FIG. 4, whilst on the right it is partially cut away to give a view of the locking-bar plate. The pivoting lever is mounted by means of its lateral projections 22 in cut-outs 24 of the side walls 2, so that there arises in the region 25 (FIG. 1) an axis of rotation which is parallel to the axis of rotation of the locking bar 13–17. It can therefore pivot at least between the two end positions illustrated in FIGS. 1 and 2. Pivoting is served, on the one hand, by a spring 26 which endeavours to pivot it in an anti-clockwise direction and, on the other hand, by the slide 27 which is guided movably in the lock body parallel to the push-in path in a way not shown, and during movement to the right butts against the upper end of the pivoting lever and thereby rotates the pivoting lever in a clockwise direction. The pivoting lever 21 is held in the retaining position by the spring 26 and by means of self-locking.

The spring 26 is appropriately designed so that it is supported at one end on the lower part of the pivoting lever and at the other end on the slide 27. The two parts are thereby urged into their normal position with a double effect. It can, of course, be of a different design from that shown in the drawing.

Above the region located between the projections 22, the pivoting lever is made narrower towards the centre. Its top part 40 (FIG. 4) forms a stop interacting with the slide. On the right and left of this (FIG. 4), it leaves room for the passage of parts 41 of the slide 27 which come together behind it (on the right of it in FIG. 1) to form an extension piece 30 of the slide.

In the embodiment according to FIGS. 1 to 3, the extension piece 30 carries a pin 42 of specific length which projects to the rear (to the right in the illustration) and on which is guided a helical spring 43 which is longer than the pin. A projection 32 projects from the top side of the locking bar 14, near its pivot axis, up behind the pin 42 and the spring 43, the length of which is such that, in the locking state of the lock, it does not reach the projection 32 and therefore does not exert any force on it.

On the rear side of the locking bar there is a plastic surface 34 which projects into the bearing cut-outs 24 behind the bearing projections 13 of the locking bar and which therefore prevents direct metallic contact between the locking-bar projections and the cut-outs and avoids rattling noises.

The arrangement described has the following mode of operation.

When the lock is in the released state (FIG. 2), the ejector plate 10 is located, in the push-in path, underneath the locking-bar part 17 of the locking bar, so that the latter cannot block the push-in path. It is therefore possible to move the push-in tongue 5 to the right into the push-in path, the ejector plate 10 likewise being pushed to the right. When the ejector plate 10 reaches the projections 20, the locking recess 6 in the push-in tongue 4 is located underneath the locking-bar part 17. During further movement, the locking bar is pivoted in an anti-clockwise direction as a result of the impact of the ejector plate 10 on the projection 20, so that the locking-bar part 17 must penetrate into the locking recess 6.

When the lock is in the released state, the lower end of the pivoting lever 21 rests under pre-stress against the forward-pointing nose of the locking-bar part 17 as a result of the spring force 26. At the moment when the locking-bar part is lowered into the locking recess in the push-in tongue, the said nose slides under the pivoting locking bar, so that the latter can rotate in an anti-clockwise direction under the effect of the spring 26, until it rests against the rear limitation 28 of the bearing cut-outs 24 (FIG. 1). At the same time, the downward-pointing nose 29 of the pivoting lever 21 is located immediately above the upward-pointing face 19 of the locking-bar part. In this position, in which the pivoting locking bar is retained by the spring 26, it secures the locking bar 13–17 in the locking position.

In the locking state, the locking face 7 of the push-in tongue 4 exerts on the locking-bar nose 18 of the locking-bar part 17 a force which is directed to the left in the direction of the push-in path and the line of influence of which runs along the push-in path and therefore at a certain distance below the pivot axis of the locking bar 13–17 determined by the cut-outs 13. If the locking bar were not secured in its position by the pivoting lever 21, a torque would therefore be created on the locking bar 13–17 in a clockwise direction, and this would urge it out of the locking position into the opening position. The geometrical ratios are selected so that this torque would normally be sufficient on its own to open the locking bar under the effect of the ejector spring 11.

When the slide 27 is moved to the right to open the lock (FIG. 3), the pivoting lever 21 is rotated in a clockwise direction, with the result that, when it passes the front edge of the locking-bar part 17, it loses its effect on the retaining face 19. The locking bar is thereby freed and can move upwards under the effect of the forces acting on it, and can release the push-in tongue as a result.

These forces are mainly generated by the spring 43 or the pin 42. When the slide 27 is pressed in, the spring 43 of the slide comes up against the projection 32 of the locking bar and presses the latter to the right. This generates a torque in a clockwise direction, which pivots the locking bar into the open position. This torque can be increased by pressing more strongly on the slide, because the spring is then compressed to a greater extent and a correspondingly greater force is generated. Should the spring force be insufficient, then finally the pin 42 strikes directly against the projection 32, as indicated in FIG. 3, so that an opening force of any magnitude can be exerted on the locking bar 14. Even under unfavourable circumstances, the user thus acquires a high degree of certainty that the locking bar is actually pivoted into the open position.

FIGS. 5 and 6 illustrate another embodiment of those parts of the lock described which transmit the opening force from the slide extension piece 30 to the locking-bar projection. Located at the rear end of the slide extension piece 30, the rear face of which is denoted by 44, are two arms 31 which, for example being in one piece with the slide, consist of an elastic plastic (for example, polyamide). They end in thickened heads 45 which are located between the locking-bar projection 32 and the rear face 44 of the slide extension piece. They extend transversely to the direction of movement of the slide. When the latter is pushed into the lock body to open the lock (FIG. 3), the heads 45 first come in contact with the locking-bar projection 32 and urge the latter, during further movement of the slide, to the right, the arms 31 being deformed resiliently, with the result that an opening force is exerted on the locking bar. When the slide is moved further to the right, there finally arises the state according to FIG. 6, in which the extension piece 30 exerts its force directly on the locking-bar projection via the heads 45, without the agency of the resilient arms 31.

We claim:

1. Buckle for a safety belt, comprising a push-in tongue (4) with a locking recess (6) and a lock with a push-in path for the push-in tongue (4), the said path being limited at least on one side by guide devices (1) and open at its front end, said lock having a locking bar (13–17) pivotally mounted in the lock for pivotal movement between a locked position and an unlocked position with a pivot axis which extends transversely to the direction of the push-in path and a locking-bar nose (18) which interacts with the locking recess (6) in the push-in tongue (4) in the locked position to latch the tongue therein and which is movable into the push-in path from the side remote from the guide devices (1), said locking bar (13–17) having a projection (32) on the side remote from the guide devices (1) bearing a first interacting surface adapted for interaction with a corresponding second interacting surface of a slide to pivot the locking bar (13–17) out of the locking position, an ejector spring (11) urging the locking bar nose (18) outwardly from the locking recess (6), a lever (21) pivotally mounted in the lock for pivotal movement between a retaining position for securing the locking bar (13–17) in the locking position and a nonretaining position allowing the locking bar (13–17) to pivot outwardly from the locking recess (6), a spring with a spring force (26) interconnected to said lever (21) for urging said lever (21) into the retaining position, a slide (27) movably mounted for movement between a locked and an unlocked position and being guided approximately parallel to the push-in path and located on the side of the latter remote from the guide devices (1), said slide (27) bearing a second interacting surface disposed for interaction with said first interacting surface of said locking bar (13–17) to pivot the locking bar out of the locking position when the slide is moved to the unlocking position, and elastically flexible means (31) for connecting one of said first and second interacting surfaces to said respective bearing locking bar and slide, said elastically flexible means comprising at least one arm extending transversely to the direction of movement of said slide to said unlocked position.

2. Buckle according to claim 1, wherein the projection (32) of the locking bar (13–17) consists of plastic.

3. Buckle according to claim 1, wherein the projection (32) is provided near the pivot axis of the locking bar (13–17).

4. Buckle according to claim 3, wherein said lock has opposing side walls (2) each having a cut-out 12 and said locking bar (13–17) has a pair of lateral projections 13 mounted within said cut-outs 12 for pivotal movement of said locking bar (13–17) transversely to the direction of the push-in path, said projection (32) being made in one piece with a plastic coating (33, 34) of the locking bar which partially covers the bearing projections (13) of the locking bar within the bearing cut-outs (12).

5. The device of claim 1 wherein said elastically flexible means connects said second interacting surface to said slide with at least a portion of said slide and said elastically flexible means being integrally formed of plastic material.

6. The device of claim 1 wherein said slide (27) has an extension piece (30) and said elastically flexible means (31) connects said second interacting surface to said extension piece of said slide.

7. The device of claim 1 wherein said elastically flexible means connects said second interacting surface to said slide.

* * * * *